United States Patent [19]

Canonge

[11] Patent Number: 4,873,773

[45] Date of Patent: Oct. 17, 1989

[54] CLOTHES DRYER FOR USE WITH FORCED AIR HEATING SYSTEM

[75] Inventor: Sidney J. Canonge, Huntington Beach, Calif.

[73] Assignee: William H. Takahashi, Anaheim, Calif.

[21] Appl. No.: 189,021

[22] Filed: May 2, 1988

[51] Int. Cl.[4] ..... F26B 19/00

[52] U.S. Cl. ..... 34/90; 34/151

[58] Field of Search ..... 34/15, 1, 240, 90, 19; 237/50, 53

[56] References Cited

U.S. PATENT DOCUMENTS 3,417,481 12/1968 Rumsey ..... 34/90 X 3,449,838 6/1969 Chancellor ..... 34/90

FOREIGN PATENT DOCUMENTS 1169238 12/1958 France ..... 34/151

*Primary Examiner*—Henry A. Bennet

*Attorney, Agent, or Firm*—Boniard I. Brown

[57] ABSTRACT

A portable clothes dryer comprises a bag having minute passages for outflow of air, preferably such that the bag assumes an inflated condition when hot air is introduced to the bag, a hot intake duct having an end connectable to a hot air register and another end connected to the bag for introduction of pressurized hot air into the bag, the bag being closable so that air outflow is substantially through the minute passages. The minute passages are defined by side walls formed of porous woven fabric with slightly spaced threads, or by minute passages about zipper structure and seams, the structure including horizontally spaced bars within the bag provide for suspending the bag in upright position. The hot air duct may have a length at least as great as the height of the bag, thus to be connectable to registers at a variety of locations. External uprights connected to the horizontal bars may be utilized for suspending the bag. The hot air duct may have a tubular frame with a transverse mounting plate engagable with an external face of a hot air register.

14 Claims, 2 Drawing Sheets

CLOTHES DRYER FOR USE WITH FORCED AIR HEATING SYSTEM

BACKGROUND OF THE INVENTION

This invention relates to a portable clothes dryer comprising an upright garment bag having a hot air duct connectable to a warm air register (outlet) of a room heating system, whereby heated air flows around clothing within the bag to remove moisture from the clothing fabric.

The invention is viewed as an improvement on devices shown in Williams, U.S. Pat. No. 1,590,143, Weber U.S. Pat. No. 2,975,529, Sullivan, U.S. Pat. No. 4,429,928, and Jordan, U.S. Pat. No. 4,572,364.

SUMMARY OF THE INVENTION

The invention contemplates an upright bag having means therein for hanging a number of garments (e.g. six or more garments) within the bag interior space; a duct delivers pressurized warm air from a room register into the bag to warm the interior space. The walls of the bag may be formed of an essentially non-porous material, such as vinyl, and have means for the limited outflow of air from the bag such as zipper structures, seams, etc. The walls of the bag may preferably be formed of a porous woven fabric that provides thousands of minute air passages through the bag walls. Heated air contained vaporized moisture passes from the bag outwardly through the minute passages.

The fabric air passages via zipper seams, etc. or via a porous woven fabric are sufficiently small as to restrict flow to exert a back pressure on the pressurized air, whereby the bag walls are caused to balloon outwardly. Heated air is in a pressurized semi-trapped state within the bag, such that the air uniformly contacts all surfaces of the clothing, including interior clothing surfaces that would otherwise not be contacted by a fast-moving air stream following only a low resistance path along outer surfaces of the clothing.

An important object of my invention is to provide a portable clothes dryer which effectively uses low pressure heated air from a warm air register. A related object is to provide a dryer wherein the heated air is caused to contact substantially all major surface areas of the clothing being dried.

DESCRIPTION OF THE PREFERRED EMBODIMENT

Figure 1:
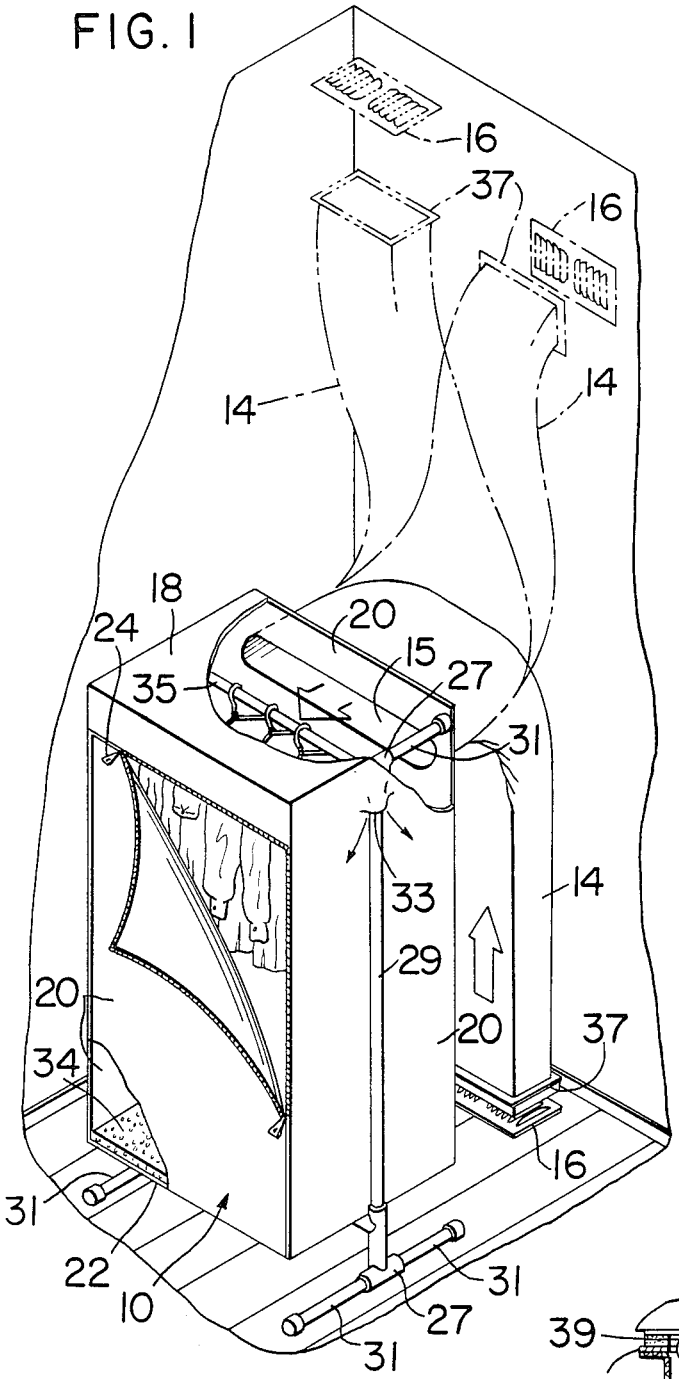
FIG. 1 is a perspective view of a portable clothes dryer embodying my invention.
Figure 2:
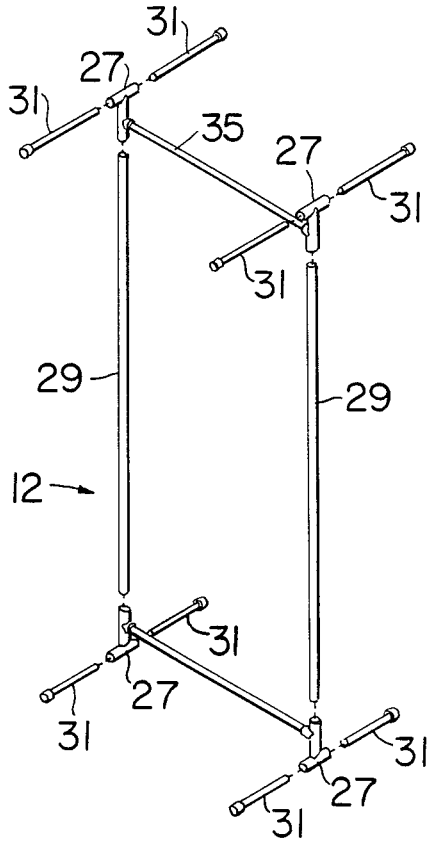
FIG. 2 is a perspective view of a bag suspension means used in the FIG. 1 embodiment.

Referring more particularly to FIGS. 1 through 4, there is shown an upright fabric bag 10 suspended from a rigid stand 12 (FIG. 2). A flexible fabric air duct 14 extends from bag 10 for connection to a hot air register 16. In use of the apparatus, hot air flows from register 16 through duct 14 into the upper interior space within bag 10. An opening 15 is formed in the bag wall to pass the air from duct 14 into the bag. Heated air flows outwardly from the bag through minute passages formed through fabric walls (by the porosity of the fabric materials), or through outflow means, such as zippers and seams, in bags of non-porous material.

FIG. 1 illustrates three alternate locations for register 16, namely on the room floor, high on a room wall, or in the ceilling. Flexible duct 14 is somewhat longer than the vertical dimension of bag 10, to permit the duct to reach any of the three register locations.

Bag 10 is an all-fabric structure, without rigidifying components that would interfere with fold-up into a storageable package form. The bag comprises a flat top wall 18, four side walls 20 depending from edge areas of wall 18, and a flat bottom wall 22. Zipper structures 24 and 26 are provided for insertion (or removal) of clothing to (or from) the bag interior. During clothes-drying periods the zippers are closed.

Rigid stand 12 comprises a number of rigid plastic pipes (tubes) detachably connected together by means of four similar couplers 27. The stand includes two uprights (pipes) 29 connected at their upper ends to two spaced horizontal bars 31. Upper end areas of uprights 29 extend through small slit-type clearance openings 33 in the bag side wall before making connections with the bars 31. Bars 31 extend within bag 10 along external edge areas of the bag top wall 18. The ends of bars 31 fit into corner areas of the bag to maintain the bag shape.

In preferred practice of the invention, a rectangular moisture-absorbent pad 34 is removably disposed within the lower end of bag 10. The pad is a semi-rigid component having a planar configuration and size-mated to the bag horizontal cross section, such that it is enabled to intercept (capture) any water droplets that might drain from clothing hanging within the bag, i.e. from clothes rod 35.

The intake end of duct 14 is attached to a "picture frame" plate or flange 37 that can engage the outer surface of hot air register 16. Flange 37 can be sealably connected to the register surface by any suitable mechanism, e.g. contact adhesive on the flange surface, permanent magnets carried on the flange, or miniature interlocking hook fabrics (trademarked Velcro) on the confronting surfaces. Numeral 39 generically references the connection mechanism.

Figure 3:
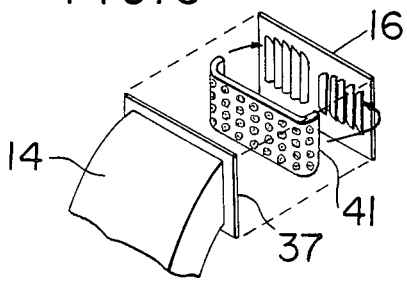
FIG. 3 is an exploded perspective view of a duct-register connection mechanism used in the FIG. 1 embodiment.
Figure 4:
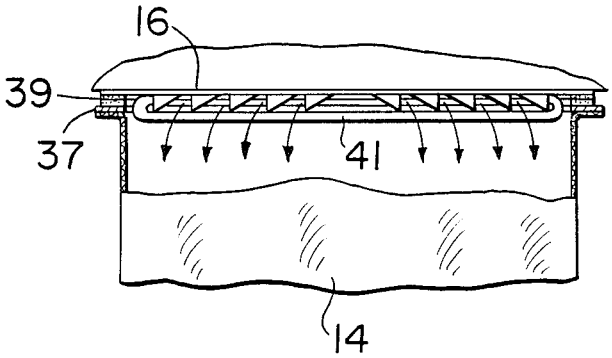
FIG. 4 is side view of the FIG. 3 duct-register connection mechanism.

FIGS. 3 and 4 show an optional air filtration pad structure 41 positionable in duct 14 to remote airborne particulates from the hot (warm) air stream being supplied to bag 10. End areas of the pad may be turned into end ones of the louvered openings in the register (for pad mounting purposes).

Figure 5:
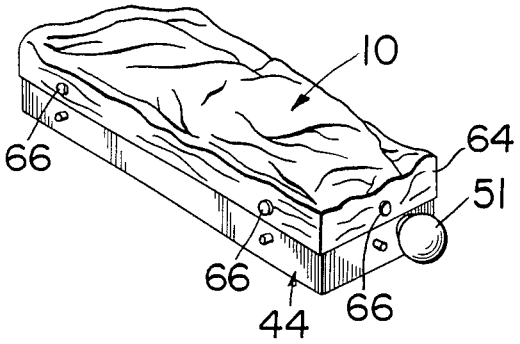
FIG. 5 is a perspective view of a second form of my invention, taken with component parts in a packaged storage condition.
Figure 6:
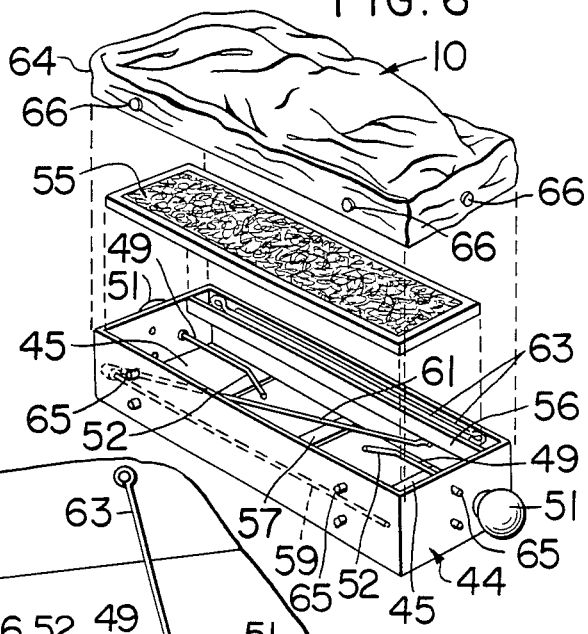
FIG. 6 is a perspective view taken in the same direction as FIG. 5, with component parts exploded.

FIG. 5 illustrates a second form of the invention designed specifically for temporary attachment to a warm air register located at an elevated point on room wall 43 (FIG. 7). the illustrated clothes dryer includes a bag 10 that is substantially identical to bag 10 of FIG. 1. The hot air supply duct is, however, constructed somewhat differently than duct 14 shown in FIG. 1.

In the arrangment of FIGS. 5 through 8 the hot air supply duct comprises a rigid tubular frame 44 (metal or rigid plastic) of rectangular cross section. This frame includes a transverse mounting plate 45 at its upstream end designed to facially engage the external face of register 16 (in a manner similar to flange 37 in the previously-mentioned embodiment).

Figure 7:
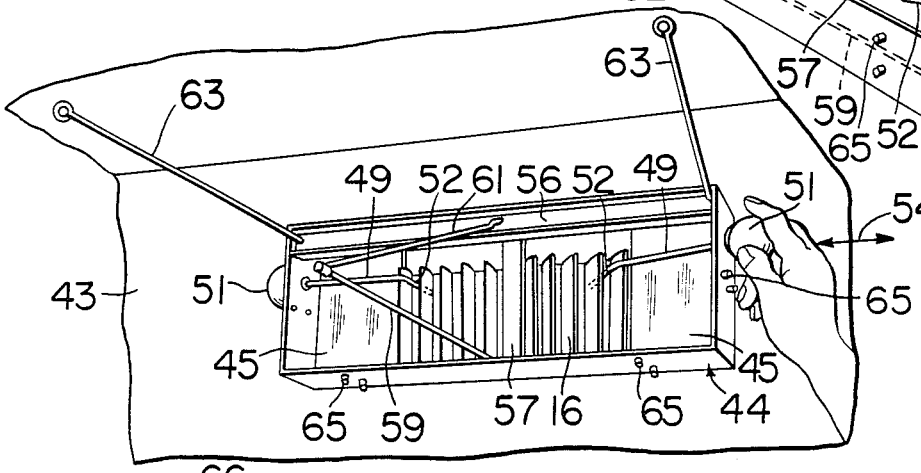
FIG. 7 is a perspective view of a rigid tubular frame forming part of the FIG. 5 assembly.
Figure 8:
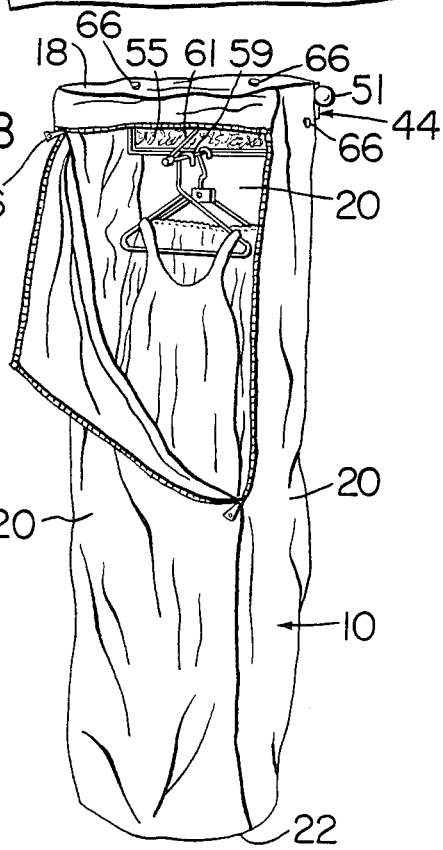
FIG. 8 is a perspective view of the FIG. 5 assembly unfolded for use as a clothes dryer.

Connection mechanisms similar to mechanism 39 (FIG. 4) may be carried on the upstream face of plate 45. Additionally, two manually-moveable clamp members 46 may be connected to frame 44. Each clamp member consists of an elongated rod having a knob 51 at one of its ends; the other end of each rod is turned (bent) as at 52. Each knob 51 can be manually grasped to push or pull to associated rod in the arrow 54 direction (FIG. 7).

A push force knob 51 causes the rod to advance toward the vertical centerline of the register; bent end 52 of the rod moves into a louver space to engage the upstream (concealed) face of a louver. The rod is wedged into the louver opening. The two rods cooperatively act to prevent frame 44 from pulling away from the warm air register. A manual pulling force on both knobs 52 can be used to disconnect frame 44 from the register.

The embodiment of FIGS. 5 through 8 includes a rectangular air filter element 55. This rectangular element fits into frame 44 below a transverse channel 56 that is welded to the roof area of the frame. A flat vertical strip 57 is welded to the upstream face channel 56 to provide a seating surface for the filter element. The filter element is manually pushed into frame 44 to abut against the face of strip 57. Edge areas of the filter panel frictionally engage inner surface areas of frame 44 to prevent dislodgement of the filter panel.

A clothes hanger rod 59 extends from frame 44 into bag 10. Rod 59 includes a horizontal rod section and an upwardly angling rod section 61. The terminal ends of the rod sections may be bent to lock into openings formed in channel 56 and the lower wall of frame 44. In the free state the rod section diverge to a greater extend than the spacing between channel 56 and the frame lower wall. To install the clothes hanger rod the rod sections are manually compressed toward each other before inserting the rod ends into the mount openings. The clothes hanger rod extends along the vertical centerline of frame 44 and bag 10. The rod ends obstruct filter panel 55 against dislodgement away from strip 57.

Bag 10 is suspended from frame 44 via two horizontal bars 63 that extend from frame 44 in cantilever fashion. Bars 63 can be hingedly connected to channel 56 for fold-up purposes. Alternately the bars can be detachably connected to the channel by insertion into sockets (tubes) that extend through web areas of the channel. Bars 63 extend within bag 10 along internal edge areas of the bag top wall 18.

Bag 10 is connected to frame 44 by means of a short frabric duct section 64. This short duct section extends right angularly from one side wall 20 of bag 10 so as to fit over (around) frame 44. Mating snap fasteners elements 65 and 66 are carried on frame 44 and fabric duct section 64 to secure the duct section against pull-off from the frame.

In service, the embodiment of FIGS. 5 through 8 functions similarly to the embodiment of FIGS. 1 through 4. Heated air flows from register 16, through frame 45, and into the upper interior space within bag 10. Moisture-laden air exits from the bag primarilly through the minute air passages in the porous fabric bag walls 20, or the air exits via the limited outflow means such as zippers amd seams, in bags o non-porous material. The bag may be equipped with a moisture-absorbent pad 22 (FIG. 1) to capture draining water droplets.

Bag 10 preferably has side walls 10 formed of a porous woven fabric; the fabric threads are slightly spaced from one another by a few-thousandths of an inch to define minute passages for outflow of air from the bag. The bag side walls can be formed of cotton, rayon, nylon, or other thread materials commonly used to make industrial dust collection bags or liquid strainer media.

In service the minute air passages offer sufficient air flow resistance that the bag assumes an inflated condition; the bag side walls balloon outwardly from their flat at-rest conditions.

Velocity pressure of the air flowing through register 16 is converted to static pressure, such that the bag is slightly pressurized with heated air. The heated air penetrates into the clothing within the bag so as to contact interior surfaces of the clothing, e.g. within sleeves, pants pockets, etc. A diffusion of moisture into and throughout the heated air mass takes place.

The described action is believed to differ from the action that occurs with known prior art arrangements that rely on a fast-moving stream of heated air to remove moisture. In such arrangements the air stream takes the the path of least resistance from the bag inlet to the bag outlet. Clothing surfaces not directly in the air stream tend not to be heated as thoroughly as surfaces in direct contact with the streams.

In my improved arrangment heated moisture-laden air exits from bag 10 via the minute air passages in the porous fabric side walls 20; some minor flow may take place through clearance openings 33 (FIG. 1). The heated air has a long residence time within the bag so that it has an increased moisture-absorption capability (compared to other known arrangements).

Thus there has been shown and described a novel clothes dryer which fulfills all the objects and advantages sought therefor. Many changes, modifications, variations and other uses and applications of the subject invention will however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A portable clothes dryer comprising:

a bag having flexible walls that have multiple minute openings therethrough for the limited outflow of air from the bag, a hot air intake duct having one of its ends connectible to a pre-existing conventional hot air register and its other end connected to said bag for introducing pressurized hot air to the bag interior space, and means for hanging items of clothing within the bag, said bag being fully closable so that outflow of air from the bag is substantially solely through said minute openings for limited outflow of air, said minute openings being sized to exert a back pressure on the pressurized air within the bag whereby the bag walls are caused to balloon outwardly such that hot air within the bag is in a pressurized semi-trapped state.

2. The clothes dryer of claim 1, wherein:

the bag has a zipper structure and seams, and the multiple openings for limited outflow of air include the zippers structure and the seams.

3. The clothes dryer according to claim 1, wherein:

said bag walls include side walls formed of a porous woven fabric having threads slightly spaced to form multiple openings for the outflow of air from the bag.

4. The clothes dryer according to claim 1, wherein:

the bag has walls formed of a porous fabric whose pores form multiple openings for outflow of air from the bag.

5. A portable clothes dryer comprising:

an upright fabric bag having a generally flat rectangular top wall, four flat side walls depending from the edges of said top wall, a rectangular bottom wall connected to the lower egdes of the side walls, seams joining edge areas of the bag side walls, a zipper structure in one of the bag side walls for insertion of clothing into the bag or removal of clothing from the bag;

a hot air intake duct having one of its ends sealably connectible to a pre-existing conventionl hot air register and its other end sealably connected to one of the bag side walls in close proximity to the bag top wall for introducing pressurized hot air to the bag interior space;

means for hanging a plural number of clothing garments within the bag;

said bag having minute passages therethrough for outflow of air from the bag interior space;

said bag being fully closable so that outflow of air from the bag takes place substantially solely through the minute passages, said passages being sufficiently small that the bag side walls balloon outwardly when hot air is introduced through the intake duct.

6. The clothes dryer of claim 5, wherein: the bag side walls are formed of a woven fabric having threads slightly spaced to form minute passages for outflow of air from the bag.

7. The clothes dryer of claim 6, wherein:

the bag side walls are formed of a non-porous material, said minute passages being located on the aforementioned zipper structure and seams.

8. The clothes dryer of claim 6, wherein:

said hot air duct is a flexible duct having a length at least as great as the vertical dimension of the bag, whereby said duct is connectible to hot air registers having a variety of different room locations.

9. The clothes dryer of claim 5:

and further comprising a bag suspension means, said bag suspension means comprising two external uprights, and two horizontal bars extending within the bag along internal edge areas of the bag top wall, each horizonatl bar having the same length as the width dimension of the associated bag side wall, said uprights having their upper ends connected to the horizontal bars at mid points therealong, said bag having clearance holes in two of its side walls to accommodate the uprights.

10. The clothes dryer of claim 8, wherein:

the external uprights are removably connected to the horizontal bars to permit insertion of the uprights through the aforementioned clearance holes.

11. The clothes dryer of claim 5, wherein:

said hot air duct includes a rigid tubular frame having a transverse mounting plate facially engageable with an external face of a hot air register.

12. The clothes dryer of claim 11, and further comprising:

movable clamp means carried by said tubular frame for insertion into the louvers of a hot air register.

13. The clothes dryer of claim 12, and further comprising:

two horizontal bars extending in a cantilever fashion from said rigid tubular frame to suspend the fabric bag in near adjacency to the hot air register, said horizontal bars extending within the bag along internal edge areas of the bag top wall.

14. The clothes dryer of claim 11, wherein:

the garment-hanging means comprising a rod extending from the rigid tubular frame into the bag.

* * * * *